US009093238B2

(12) United States Patent
Knab et al.

(10) Patent No.: US 9,093,238 B2
(45) Date of Patent: Jul. 28, 2015

(54) FUSE FOR INTERRUPTING A VOLTAGE AND/OR CURRENT-CARRYING CONDUCTOR IN CASE OF A THERMAL FAULT AND METHOD FOR PRODUCING THE FUSE

(75) Inventors: Norbert Knab, Appenweier (DE); Georg Schulze-Icking-Konert, Buehlertal (DE); Thomas Mohr, Buehlertal (DE); Stefan Kotthaus, Sinzheim (DE); Nikolas Haberl, Sinzheim (DE); Stefan Stampfer, Bietigheim-Bissingen (DE); Michael Mueller, Rutesheim (DE)

(73) Assignee: Robert Bosch GmbH, Stuttgart (DE)

( * ) Notice: Subject to any disclaimer, the term of this patent is extended or adjusted under 35 U.S.C. 154(b) by 199 days.

(21) Appl. No.: 12/532,971

(22) PCT Filed: Feb. 14, 2008

(86) PCT No.: PCT/EP2008/051769

§ 371 (c)(1),
(2), (4) Date: Sep. 24, 2009

(87) PCT Pub. No.: WO2008/116698

PCT Pub. Date: Oct. 2, 2008

(65) Prior Publication Data

US 2010/0085141 A1 Apr. 8, 2010

(30) Foreign Application Priority Data

Mar. 26, 2007 (DE) ..... 10 2007 014 332
Jan. 9, 2008 (DE) ..... 10 2008 003 659

(51) Int. Cl.
*H01H 85/06* (2006.01)
*H01H 85/055* (2006.01)

(Continued)

(52) U.S. Cl.
CPC ..... *H01H 37/761* (2013.01); *H01H 69/02* (2013.01); *H01H 85/0418* (2013.01);

(Continued)

(58) Field of Classification Search
CPC . H01H 85/044; H01H 85/055; H01H 85/042; H01H 85/38; H01H 85/36; H01H 85/165; H01H 85/10; H01H 85/43; H01H 85/06; H01H 85/046; H01H 31/127; H01H 1/52; H01H 37/761; H01H 2037/768; H01H 69/02; H01H 85/143; H01H 85/157; H01H 85/0418; H01H 85/0458; H01R 33/95; Y10T 29/49107
USPC ..... 337/227, 152, 159, 160, 180, 181, 290, 337/158, 296, 413; 420/561, 562, 559, 577; 29/623; 148/400
See application file for complete search history.

(56) References Cited

U.S. PATENT DOCUMENTS 2,464,340 A * 3/1949 Newbill ..... 337/405
3,168,632 A 2/1965 Baran et al.

(Continued)

FOREIGN PATENT DOCUMENTS

DE 1 588 425 5/1971
DE 39 09 302 10/1989

(Continued)

*Primary Examiner* — Anatoly Vortman
(74) *Attorney, Agent, or Firm* — Michael Best & Friedrich LLP

(57) ABSTRACT

A fuse (10) is proposed for interrupting a voltage and/or current-carrying conductor (12) in case of a thermal fault, having a conductor bar (14) ensuring an electrically conductive connection of the voltage and/or current-carrying conductor during correct operation, said fuse (10) being characterized in that the conductor bar (14) melts upon an increase in temperature above the melting point, and the electrically conductive connection of the voltage and/or current-carrying conductor is interrupted due to inherent surface tension. Also proposed is a method for producing the fuse (10) according to the invention.

26 Claims, 5 Drawing Sheets

(51) Int. Cl.

| | |
|---|---|
| ***H01H 69/02*** | (2006.01) |
| ***H01H 37/76*** | (2006.01) |
| ***H01H 85/041*** | (2006.01) |
| ***H01H 85/143*** | (2006.01) |
| ***H01H 85/157*** | (2006.01) |
| ***H01H 85/045*** | (2006.01) |
| *H01H 85/165* | (2006.01) |
| *H01H 1/52* | (2006.01) |

(52) U.S. Cl.

CPC ..... *H01H 85/0458* (2013.01); *H01H 85/055* (2013.01); *H01H 85/143* (2013.01); *H01H 85/157* (2013.01); *H01H 1/52* (2013.01); *H01H 85/06* (2013.01); *H01H 85/165* (2013.01); *H01H 2037/768* (2013.01); *Y10T 29/49107* (2015.01)

(56) References Cited

U.S. PATENT DOCUMENTS

| | | | | | |
|---|---|---|---|---|---|
| 3,354,282 | A | * | 11/1967 | Batsch | 337/234 |
| 3,377,448 | A | | 4/1968 | Baumbach | |
| 3,386,063 | A | | 5/1968 | Mansfield | |
| 4,186,365 | A | * | 1/1980 | Fahnoe | 337/206 |
| 4,198,617 | A | * | 4/1980 | Hara | 337/403 |
| 4,441,093 | A | * | 4/1984 | Okazaki | 337/404 |
| 4,625,195 | A | * | 11/1986 | Robbins | 337/159 |
| 4,652,848 | A | * | 3/1987 | Hundrieser | 337/297 |
| 4,851,806 | A | * | 7/1989 | Rohrer et al. | 337/231 |
| 4,944,084 | A | | 7/1990 | Horibe et al. | |
| 4,973,932 | A | * | 11/1990 | Krueger et al. | 337/164 |
| 4,999,499 | A | * | 3/1991 | Bhatt | 250/342 |
| 5,140,294 | A | * | 8/1992 | Rohrer et al. | 337/278 |
| 5,198,792 | A | * | 3/1993 | Bacon et al. | 337/251 |
| 5,247,344 | A | * | 9/1993 | Doan | 356/394 |
| 5,252,942 | A | * | 10/1993 | Gurevich | 337/163 |
| 5,631,621 | A | * | 5/1997 | Nakajima | 337/280 |
| 5,821,847 | A | * | 10/1998 | Totsuka | 337/166 |
| 6,222,438 | B1 | * | 4/2001 | Horibe et al. | 337/290 |
| 6,636,403 | B2 | * | 10/2003 | McLoughlin et al. | 361/103 |
| 6,737,770 | B2 | | 5/2004 | Sunaga et al. | |
| 6,838,971 | B2 | * | 1/2005 | Senda et al. | 337/296 |
| 7,038,569 | B2 | * | 5/2006 | Hamada | 337/290 |
| 7,042,327 | B2 | * | 5/2006 | Tanaka et al. | 337/290 |
| 7,106,165 | B2 | * | 9/2006 | Mukai et al. | 337/405 |
| 7,142,088 | B2 | * | 11/2006 | Tanaka | 337/290 |
| 2002/0113685 | A1 | * | 8/2002 | Izaki et al. | 337/405 |
| 2004/0100352 | A1 | * | 5/2004 | Tanaka | 337/159 |
| 2004/0174243 | A1 | * | 9/2004 | Tanaka | 337/159 |
| 2004/0196133 | A1 | * | 10/2004 | Kawanishi | 337/159 |
| 2005/0001710 | A1 | * | 1/2005 | Mukai et al. | 337/297 |
| 2005/0007234 | A1 | * | 1/2005 | Wada et al. | 337/405 |
| 2005/0140491 | A1 | * | 6/2005 | Uehara et al. | 337/401 |
| 2006/0097839 | A1 | * | 5/2006 | Tanaka | 337/159 |
| 2006/0152327 | A1 | * | 7/2006 | Hamada | 337/159 |
| 2006/0267722 | A1 | * | 11/2006 | Graf et al. | 337/297 |
| 2008/0084267 | A1 | * | 4/2008 | Jollenbeck et al. | 337/246 |
| 2010/0090792 | A1 | * | 4/2010 | Whitney et al. | 337/251 |

FOREIGN PATENT DOCUMENTS

| | | | | |
|---|---|---|---|---|
| EP | 1 120 888 | | 8/2001 | |
| JP | 11 073869 | | 3/1999 | |
| JP | 2001243863 | A * | 9/2001 | H01H 37/76 |
| WO | WO 00/08665 | | 2/2000 | |

* cited by examiner

FUSE FOR INTERRUPTING A VOLTAGE AND/OR CURRENT-CARRYING CONDUCTOR IN CASE OF A THERMAL FAULT AND METHOD FOR PRODUCING THE FUSE

This application is a National Stage Application of PCT/EP2008/051769, filed 14 Feb. 2008, which claims benefit of Serial No. 10 2007 014 332.1, filed 26 Mar. 2007 in Germany, and Serial No. 10 2008 003 659.5, filed 9 Jan. 2008, in Germany and which applications are incorporated herein by reference. To the extent appropriate, a claim of priority is made to each of the above disclosed applications.

TECHNICAL FIELD

The invention relates to a fuse for interrupting a voltage and/or current-carrying conductor in case of a thermal fault and a method for producing the fuse according to the class of the independent claims.

BACKGROUND

Especially devices with a very high current load often do not provide the possibility for separating the corresponding control and/or power electronics from the power source in case of a thermal fault, i.e. for example when very high ambient temperatures, which are significantly above 100 EC, occur as a result of middle- or low-resistance short circuits. Appropriate temperature fuses for preventing thermal damages are, however, necessary in particular in motor vehicles.

It is, for example, known from the U.S. Pat. No. 6,737,770 B2 how to separate the coil of a brushless motor from the power source by means of a fuse. In so doing, an end of the fuse is soldered on; so that when a certain limit temperature is exceeded, the mechanically biased part of the fuse leads to a separation of the soldered joint.

In the European patent EP 1 120 888 A1, a heat-resisting mechanism is disclosed, which is thermally coupled to a heat sink of a circuit breaker and separates the power source of a brushless motor from the coil. As is the case in the U.S. Pat. No. 6,737,770 B2, an end of the fuse is also soldered on here. When a certain limit temperature is exceeded, the mechanically biased part of the fuse thus leads to a separation of the soldered joint. A corresponding fuse is furthermore known from the patent WO 00/08665.

The German patent DE 39 09 302 A1 reveals a fuse, in which a new alloy with a high electrical resistance arises from the melting of two highly electrically conductive alloys. Said new alloy prevents a further flow of high currents.

A disadvantage of the aforementioned fuses is, for example, the limited service life as a result of a permanently mechanically biased, soldered joint. Furthermore, insufficiently high tolerances can arise due to a simultaneous influence of temperature and current. A satisfactory and safe usage, in particular for the automotive field, is therefore basically not provided.

SUMMARY

The invention relates to a fuse for interrupting a voltage and/or current-carrying conductor in case of a thermal fault, having a conductor bar ensuring an electrically conductive connection of the voltage and/or current-carrying conductor during correct operation. In an advantageous manner, the conductor bar melts upon an increase in temperature above the melting point so that the electrically conductive connection of the voltage and/or current-carrying conductor is interrupted due to the surface tension of the conductor bar. The melting point of the conductor bar is selected thereby in such a way that on the one hand a melting of the conductor bar can be ruled out during correct operation, while on the other hand the melting is ensured in case of a thermal fault. In particular for electric motors with or without electronics, a safe and reliable de-activating path is consequently ensured, which essentially depends on the temperature and not on the current, when inadmissibly high temperatures occur, for example, due to breakdowns of components or short circuits resulting from external impacts or malfunctions of insulating materials. In this way, an activation of the fuse is also possible for disturbances, which only lead to small currents beneath the admissible maximum currents. Moreover, a mechanical bias of the fuse can be avoided so that said fuse is not exposed to any additional stress. This fact leads to a significantly longer service life with respect to the fuses according to the state of the art.

The invention furthermore relates to a method for producing the fuse with a retaining element and a conductor bar for interrupting a voltage and/or current-carrying conductor in case of a thermal fault. The retaining element has a first and a second part, the second part serving to connect said retaining element to the voltage and/or current-carrying conductor and the conductor bar being affixed, respectively inserted, in a force-fitting or positive-locking manner on or into the first part of said retaining element. The fuse can consequently be advantageously produced independent from the later application.

According to the invention, at least one end of the conductor bar is held by a retaining element of the fuse. Said retaining element has a first part for holding the conductor bar and a second part for connecting the retaining element to a stamped grid, a printed circuit board or the like. In this way the fuse can very easily be integrated into varying applications.

The first part of the retaining element is configured in an advantageous manner as a hollow body having one open side. The conductor bar is fixed inside the hollow body by a soldering metal, the melting point of the solder lying below that of the conductor bar and above the maximally admissible temperature for correct operation.

In order to achieve a still better fixing of the conductor bar to the retaining element, the hollow body has at least one raised portion on its outer circumference, which constitutes a point of force application for a mechanical deformation of the hollow body for holding the conductor bar. The first part can, however, also alternatively be configured as an obtuse contact surface.

The first part and the second part of the retaining element are advantageously implemented as one piece. It is also, however, possible for both parts to be welded or riveted together. In order to allow for a good connection and one made as easy as possible to the stamped grid or to the printed circuit board, the second part of the retaining element is of bar-, wire- or strip-like form. It is furthermore possible in this connection for the second part to be angled with respect to the preferred orientation of the conductor bar for the purpose of strain relief. The retaining element can also additionally be an integral component part of the stamped grid.

In a particularly advantageous manner, the conductor bar consists of metal or a highly electrically conductive alloy, in particular a soft solder alloy such as Sn, SnAG, SnAgCu or the like. A sufficiently sound thermal connection to the environment as well as a sufficiently low specific resistance of the conductor bar is furthermore ensured by a sufficiently large cross-section. In so doing, said bar warms up only slightly with respect to the environment even when the current is at a maximally admissible level. Furthermore, an improved, i.e. more reliable, melting behavior in connection with the surface tension is achieved if the conductor bar has a flux core. It is also advantageous if the core of the conductor bar comprises an activator-medium, which consists of carboxylic acid or a salt of the carboxylic acid, contains carboxylic acid or a salt of the carboxylic acid or contains a mixture of carboxylic acid and a resin or a salt of the carboxylic acid and a resin. As a result, a significant increase in the activation temperature for such a fuse is possible with respect to a fuse on the basis of media containing rosin as a flux. By using the activator-media as a flux instead of using rosin, the thermal application range of such a fuse can be greatly expanded in this way.

As an alternative to a flux core, the conductor bar can also have a flux coating, which contains a carboxylic acid or a salt of a carboxylic acid. In particular the flux coating can be embodied by a coat of lacquer. This provides the advantage of being able to apply the coat of flux to the fuse from the outside after soldering the conductor bar to the retaining element. On the one hand, such a procedure can be easily implemented during manufacturing, and on the other hand it does not require transient liquid phase soldering, whereby the flux potentially runs when soldering the conductor bar into the retaining element. The fuse can thereby prematurely activate.

Provision is made in an advantageous manner for the following steps with regard to the method according to the invention for producing the fuse:

- solder is applied to a first part of the retaining element in such a way that a base and/or an interior wall of the first part is bathed with the solder,
- the retaining element and/or the conductor bar are heated to a temperature value between the melting point of the solder and the melting point of the conductor bar,
- the conductor bar is affixed to or inserted in the first part of the retaining element in such a way that the conductor bar comes in contact with the solder and the fuse is cooled down in such a way that the solder solidifies.

It is additionally advantageous if the hollow body is mechanically deformed before or after being heated. The heating can also first take place after inserting the conductor bar into the hollow body. Moreover, it is possible in an advantageous way to attain heating by a thermal pulse, which is impressed on the second part of the retaining element, on the raised portion of the hollow body or on the conductor bar. The thermal pulse can also alternatively be impressed in a non-contact manner by laser or infrared light. The duration of the thermal pulse must thereby be selected in such a way that the conductor bar definitely melts only in the interior of the hollow body, in particular in the region of a base or of the raised portions of said body. A melting outside of the hollow body as a result of a thermal pulse lasting too long is on the other hand worth avoiding. In this context, splashing the conductor bar with a coolant outside of the hollow body of the retaining element, immersing the conductor bar in the coolant or mechanically clamping it to a thermal ground can be advantageous, the jaws of a holding tool serving as a thermal ground. If the second part of the retaining element is of strip-like form, the additional strip material can also serve as a thermal ground, provided the impressing of the thermal pulse occurs before the second part is punched out.

Corresponding to the previous embodiments of the conductor bar with a flux coating, provision can also be made in the method for a step, which applies a flux or activator to the conductor bar, the flux in this form of embodiment develops, for example a lacquer layer around the conductor bar. In particular when a conductor bar without an internal flux core is used, said aforementioned step provides the advantage that a significantly simpler and more reliable manufacturing method can be employed for the production of the fuse.

In order to check for the correct production of the fuse, provision can also be made in the method for a step to check the connection between the first part of the retaining element and the conductor bar affixed or inserted in a force-fitting or positive-locking manner. In so doing, the check can take place automatically or optically in an advantageous way. A probe, which is disposed as to be freely displaceable, can therefore also be used to cover a region to be checked in the first part of the retaining element. In so doing, the opportunity is provided to also assure the correct manufacturing and with it the accurate functionality of the manufactured fuse by the continued use of present devices for the control of the manufacturing of a printed circuit board, respectively its assembly. This is done without an extensive technical outlay with additional expenses. An operating result for confirming a flawless soldering can be specially supplied during the checking step if a solder meniscus is detected when the first part of the retaining element is connected to the conductor bar, which is inserted in a force-fitting and/or positive-locking manner. Such a function check can be simply and cost effectively implemented by the proposed use of the probe and the evaluation of the reflection pattern of the solder joint.

BRIEF DESCRIPTION OF THE DRAWINGS

The invention is paradigmatically described below with the aid of the FIGS. 1 to 9, like reference numerals in the Figures pointing to like components with a similar functionality. The Figures of the drawing, their description as well as the claims contain numerous characteristics in combination. A specialist will also individually consider these characteristics and put them together to form additional meaningful combinations. A specialist will also put together characteristics from different examples of embodiment to form meaningful combinations. The following are shown:

DETAILED DESCRIPTION

Figure 1:
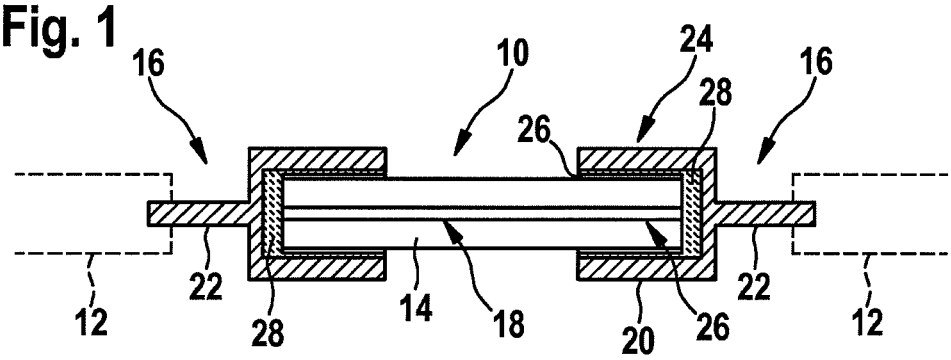
FIG. 1 is an example of embodiment of the fuse according to the invention.

An example of embodiment of the fuse 10 according to the invention for interrupting a voltage and/or current-carrying conductor 12 in case of a thermal fault is depicted in FIG. 1. The fuse 10 comprises a conductor bar 14, which ensures an electrically conductive connection of the voltage and/or current-carrying conductor 12 to supply, for example, an electric motor or a control, respectively power, electronics during correct operation. Said fuse 10 also comprises two preferably identical retaining elements 16 for fixing the conductor bar 14 at both of its ends and for contacting the conductor bar 14 to the voltage and/or current-carrying conductor 12.

The conductor bar 14 is made from metal or a highly electrically conductive alloy, in particular a soft solder alloy like tin (Sn), tin-silver (SnAg), tin-silver-copper (SnAgCu) or the like. Its cross-section, its thermal connection to the environment as well as its specific resistance is selected in such a way that the conductor bar 14 warms up only marginally with respect to the environment when a maximally admissible current is present. This requirement is met, for example, by a conductor bar 14 of bar-like form with a very small specific resistance. The melting point of the conductor bar 14 is furthermore selected in such a way that on the one hand melting can be assuredly ruled out during correct operation, while on the other hand said melting is ensured in case of a thermal fault, i.e. when temperature increases occur as a result of operational disturbances, such as, for example: breakdowns of electronic components, malfunctions of the insulating materials, middle- or low-resistance short circuits due to external impacts or the like, in connection with the surface tension of the conductor bar 14. Said melting thus interrupts the current path between the two retaining elements. An assured melting of the conductor bar 14 can furthermore be achieved as a result of said bar 14 additionally having a flux core 18, whereby the flux is known to the specialist and need not be specified here. A suitable flux is, however, especially characterized in that it is non-corrosive during correct operation and furthermore does not age or ages only to a small extent.

Each retaining element 16 consists of a first part 20 for holding the conductor bar 14 and a second part 22 for connecting the retaining element 16 to the voltage and/or current-carrying conductor 12, which, for example, can be configured as a stamped track of a stamped grid, as a conductor path of a printed circuit board, as a cable or the like. The first part 20 is configured in the example of embodiment according to FIGS. 1 and 2 as a hollow body 24 in the form of a cup and having one open side. The conductor bar 14 is held in the interior 26 of said hollow body 24 by a solder joint 28 in the manner of a form-fit. In so doing, the solder 28 is selected in such a way that its melting point lies below that of the conductor bar 14 and above the maximally admissible temperature for the correct operation.

Figure 2:
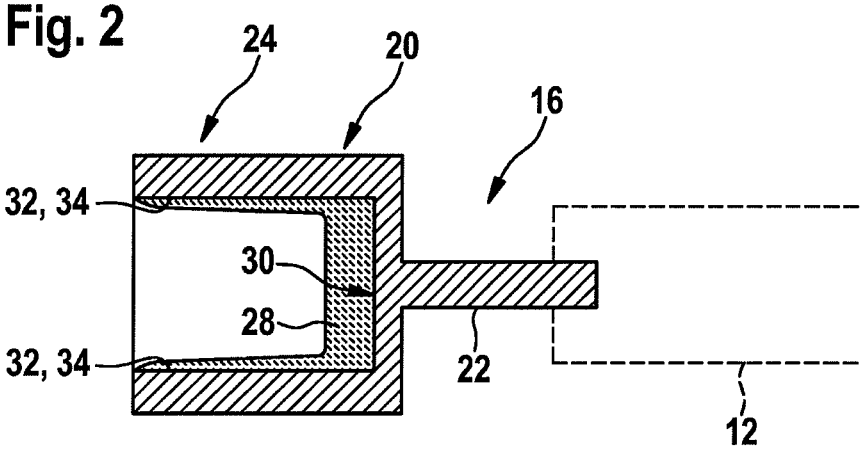
FIG. 2 is a first example of embodiment of a retaining element of the fuse according to the invention.

FIG. 2 shows the retaining element 16 from FIG. 1 in a somewhat enlarged depiction. As can be seen from the figure, a base 30 of the hollow body 24 is essentially covered by the solder 28. In addition, the lateral interior walls 32 (in the case of a square cross-section of the conductor bar 14) or the lateral interior surface 34 (in the case of a round or oval cross-section of the conductor bar 14) of the hollow body 24 can be covered with the solder 28 in order to allow for the conductor bar 14 to be held in an improved fashion.

The second part 22 of the retaining element 16 is of bar-, wire-, or strip-like form for connecting to the voltage and/or current-carrying conductor 12, depending on whether said voltage and/or current-carrying conductor 12 relates to a stamped track, a cable or a conductor path. In an advantageous manner, the first part 20 and the second part 22 of the retaining element 16 are embodied as one piece. It is, however, also conceivable that the two parts 20 and 22 are welded or riveted together. In order to ensure an improved strain relief of the fuse, particularly the second part 22, which is of wire-like form, can also be angled. This is, however, not shown in the figures.

Figure 3:
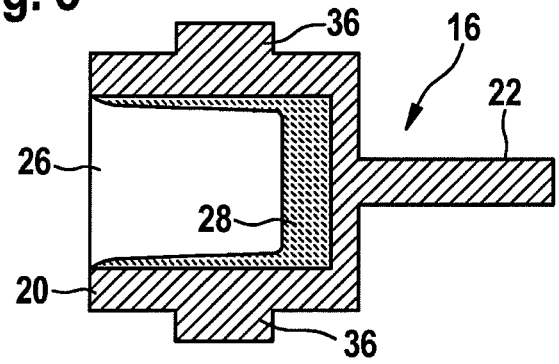
FIG. 3 is a second example of embodiment of the retaining element of the fuse according to the invention.

FIG. 3 shows a second example of embodiment of the retaining element 16 or the fuse 10 according to the invention. Raised portions are thereby affixed to the outer circumference of the first part 20 of the retaining element 16, which is configured as a hollow body 24. Said raised portions constitute a point of force application for a mechanical deformation of the hollow body 24 after inserting the conductor bar 14 for its improved fixation in a force-fitting manner.

Figure 4B:
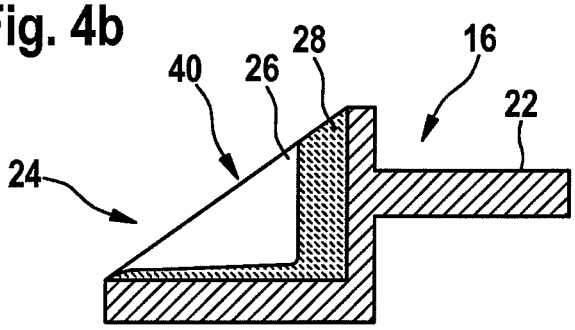
FIG. 4 shows a third and a fourth example of embodiment of the retaining element of the fuse according to the invention.
Figure 4A:
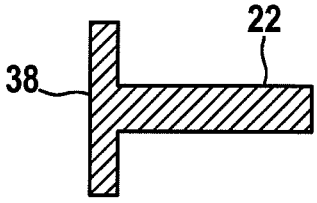

A third and a fourth example of embodiment of the retaining element 16 can be seen in FIG. 4. While the first part 20 of the retaining element 16 is configured as an obtuse contact surface 38 according to FIG. 4*a*, FIG. 4*b* shows an additional chamfer 40 of the first part 20, which is embodied as a hollow body 24. The partial overlapping of the conductor bar 14 by the chamfered hollow body 24 has the advantage that the quality of the soldering in the interior 26 of the hollow body 24 can be better assessed in this manner. A corresponding assessment is also alternatively possible by means of a slot disposed in the hollow body 24—not shown here.

The manufacture of the fuse 10 according to the invention takes place now in such a way that the conductor bar 14 is affixed, respectively inserted, on or into the first part 20 of the retaining element 16 in a form-fitting and/or positive-locking manner. Provision can additionally be made for the solder 28 to initially be applied in or on the first part 20 of the retaining element 16. In so doing, the contact surface 38, respectively the base 30 and/or an interior wall 32, respectively interior surface 34, of the first part 20 are covered with solder 28, which melts at a lower temperature in comparison to the conductor bar 14. By means of a suitable device, the retaining element 16 and/or the conductor bar 14 are then heated to a temperature value between the melting point of the solder 28 and the melting point of the conductor bar 14. While the solder 28 is fluid, the conductor bar 14 is inserted, respectively affixed, in such a way into or onto the first part 20 of the retaining element 16 so that the conductor bar 14 comes into contact with the solder 28. Finally the cooling down of the fuse 10 occurs and with it the connection of the conductor bar 14 with the retaining element 16 in a positive-locking manner, for example by splashing the conductor bar 14 outside the first part 20 with a coolant. The conductor bar 14 can also alternatively be immersed in the coolant or mechanically clamped to a thermal mass, for example to the jaws of a holding tool. If the second part 22 of the retaining element 16 is of strip-like form, the additional strip material can also serve as a thermal ground.

If the first part 20 of the retaining element 16 is configured as a hollow body 24, a force-fit connection between the retaining element 16 and the conductor bar 14 can additionally be achieved prior to or after heating by a mechanical deformation serving as a stamping process by means of the raised portions 36.

The heating occurs by a thermal pulse, which is impressed on the second part 22 of the retaining element 16, on the raised portion 36 of the hollow body 24 or on the conductor bar 14. A contactless heating by a laser, infrared light or the like is also possible. In so doing, the duration of the thermal pulse must be selected in such a way that the conductor bar 14 definitely melts only in the interior 26 of the hollow body 24, in particular in the region of the base 30 or the raised portions 36 of the hollow body 24. Melting of the conductor bar 14 outside of the hollow body 24 as a result of the thermal pulse lasting too long is worth preventing with the aid of the cooling procedure already described. As a rule, said procedure can, however, be dispensed with because the thermal pulse can be applied very precisely. Finally it should be mentioned that the heating can alternatively take place right after inserting the conductor bar 14 into the hollow body 24.

Figure 5A:
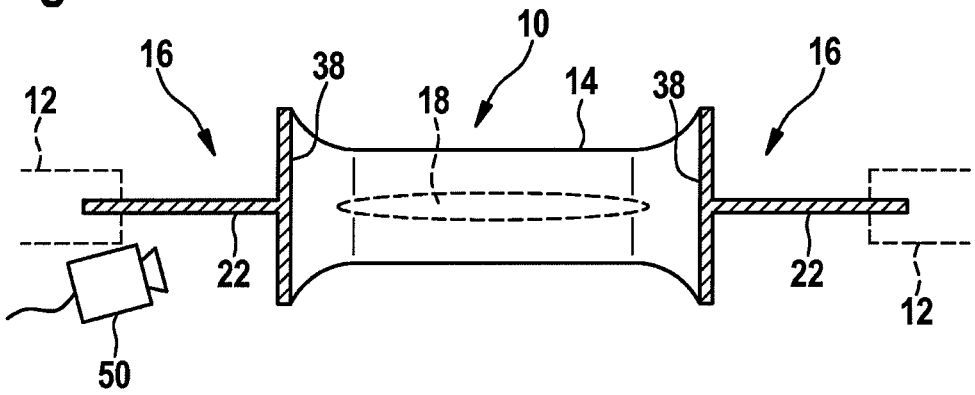
FIGS. 5A and 5B show a fifth and sixth example of embodiment of the retaining element of the fuse according to the invention, wherein a soldering meniscus is examined to assure the quality of the solder joint between the retaining element and the conductor bar.
Figure 5B:
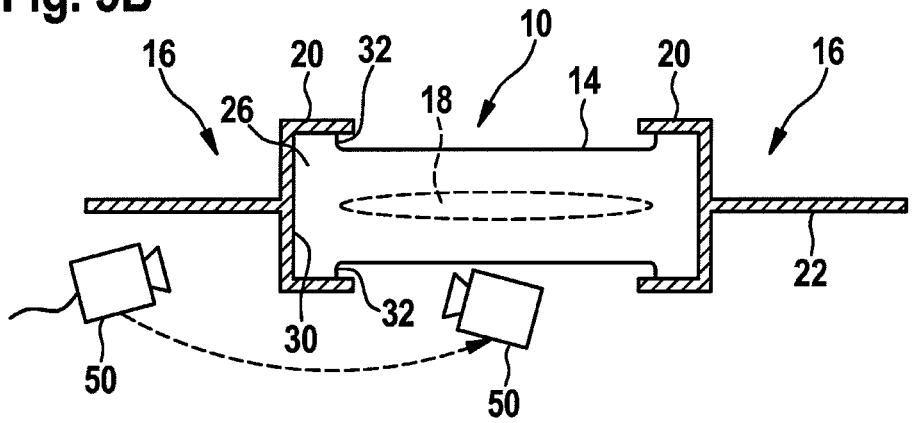

Furthermore, the quality of the fuse produced, respectively terminated, should also be examined. For a terminated fuse, the soldering between the fuse and the termination, i.e. the retaining element, is essential for its operation and reliability. The open geometry of the termination (flat or U-shaped) introduced here allows for an AOI (AOI=automated optical inspection). Said AO I is employed here in the same fashion as it can also be employed in the case of printed circuit board assembly. In the method proposed here, the soldering meniscus is analyzed, which only forms when the soldering is done correctly. In FIG. 5A, such an examination is depicted in the case of a retaining element 16 with an obtuse contact surface 38. In this instance, the optical examination unit 50, which can also be employed for the examination of the correct assembly of the printed circuit board, is used for controlling the soldering meniscus between the retaining element 16 and the conductor bar 14. This provides a very cost effective and simple possibility for checking the soldering meniscus and thereby also for checking the operation of the fuse. In FIG. 5B, the checking of a soldering meniscus is depicted for the case where a cup-shaped retaining element 16 is used. During the checking procedure the optical examination unit 50 is then pivoted in such a way that it can detect a soldering meniscus region 52, which lies in the interior 26 of the retaining element 16. This, however, presents no problem for standard optical examination units, which are used for inspecting printed circuit board assemblies. Thus, in this case a cost effective and simple possibility for checking the soldering meniscus is possible.

Figure 6A:
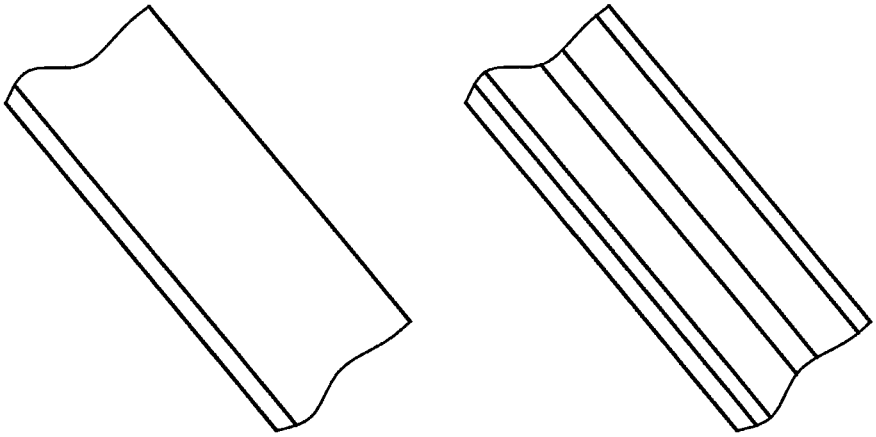
FIGS. 6A and 6B show illustrations of solder strips with the core containing rosin as well as diagrams, which depict the temperature and time dependent deformation of the solder strip.
Figure 6B:
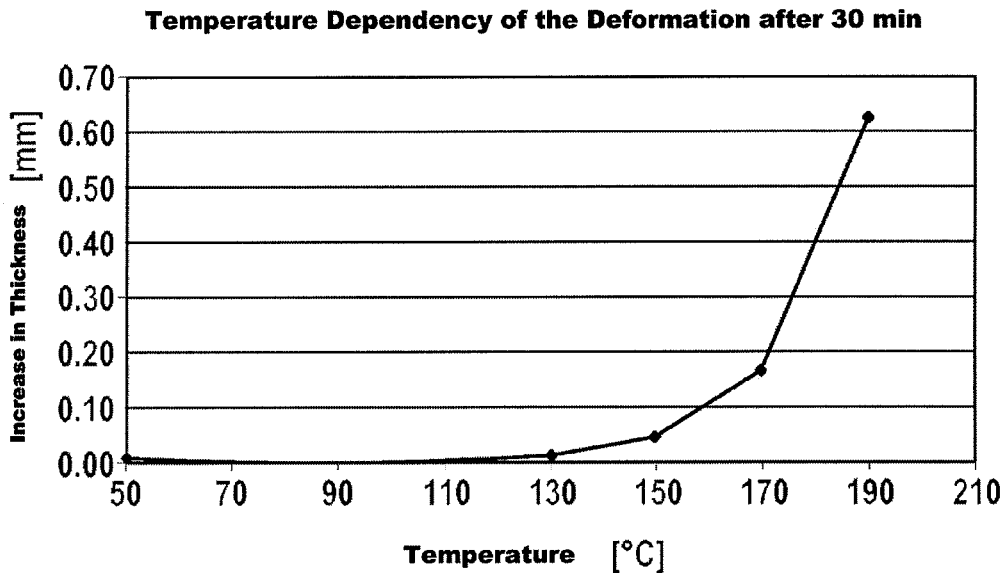
Figure 6B:
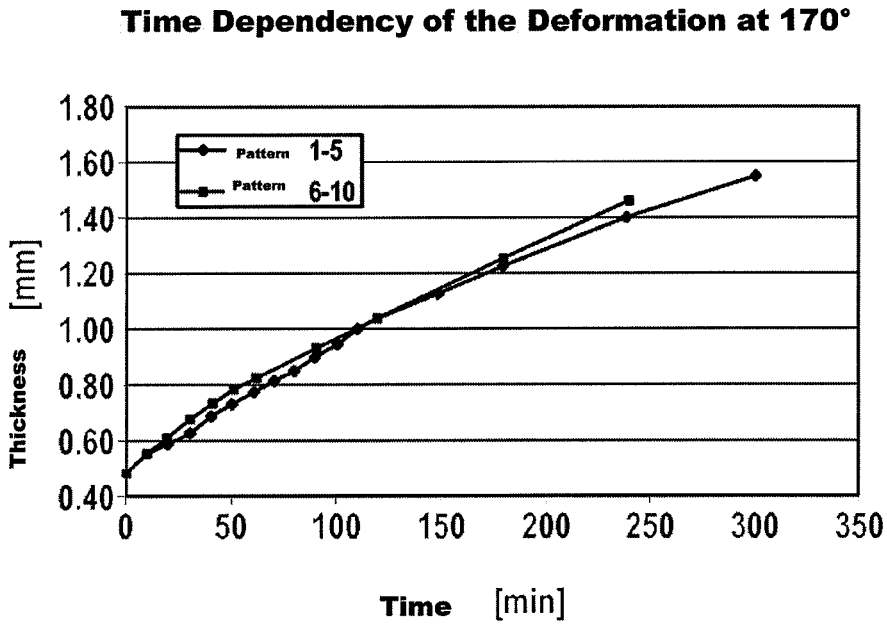

Thermal fuses with an internal flux core were described. Known thermal fuses on the basis of molten bridges are characterized in contrast by a flux, which has been coated on the molten bridge. The flux used in such a fuse is thereby based on rosin, which becomes liquid at approximately 100 EC and produces a high vapor pressure at 140 EC, which leads to a rapid evaporation. For this reason, the customary molten bridges are always enclosed by a ceramic sleeve, which is intended to prevent the loss and aging of the flux. This ceramic sleeve, however, enlarges the structural shape, increases the self-heating and the heating output (on account of the long connections) and increases the manufacturing costs. It has become apparent in tests that a flux core containing rosin leads to a mechanical deformation of the molten bridge through its vapor pressure already from temperatures starting at approximately 120 EC. FIG. 6 shows this connection in more detail. In partial FIG. 6A, two solder strips with a core containing rosin are illustrated, which were used for the additional examinations. In the upper diagram comprising partial FIG. 6B, the temperature dependency of a deformation of the solder strips after 30 minutes is depicted in the form of an increase in thickness measured in mm. In the lower diagram comprising partial FIG. 6B, the time dependency of the deformation of the solder strips at 170 EC is depicted as a thickness measured in mm. It is especially apparent from the upper diagram comprising partial FIG. 6B that a significant increase in thickness and thereby the deformation of the solder strips occurs with a core containing rosin starting at a temperature of approximately 130 EC. For this reason, care should be taken that only substances, which have the following characteristics, should be used for an internal flux core:

- negligible aging in the absence of air at the maximum operating temperature $T_{maxi}$
- ideally melting point>$T_{max}$ (which does not lead to an activation or a deformation through melting); and
- negligible vapor pressure at $T_{max}$ (which does not lead to a deformation through vapor pressure), $T_{max}$ denoting that temperature, whereat the fuse does not quite activate.

Promising candidates are found in the class of organic carboxylic acids (or their salts), which have melting temperatures in the range of up to >170 EC. For this reason, such materials permit the construction of fuses, which first activate at an ambient temperature of 170 EC. This represents a significantly higher activation temperature for fuses with respect to the known fuses. These organic carboxylic acids by themselves or mixed with resins can be used as an alternative to rosin based fluxes. In their pure form, carboxylic acids are therefore not designated as a flux but as an "activator". For the aforementioned application as a flux, respectively its replacement, pure carboxylic acid or a synthetic flux consisting of an activator and resin can be used. In the latter case, the resin used should also have the characteristics which were previously stated.

Figure 7:
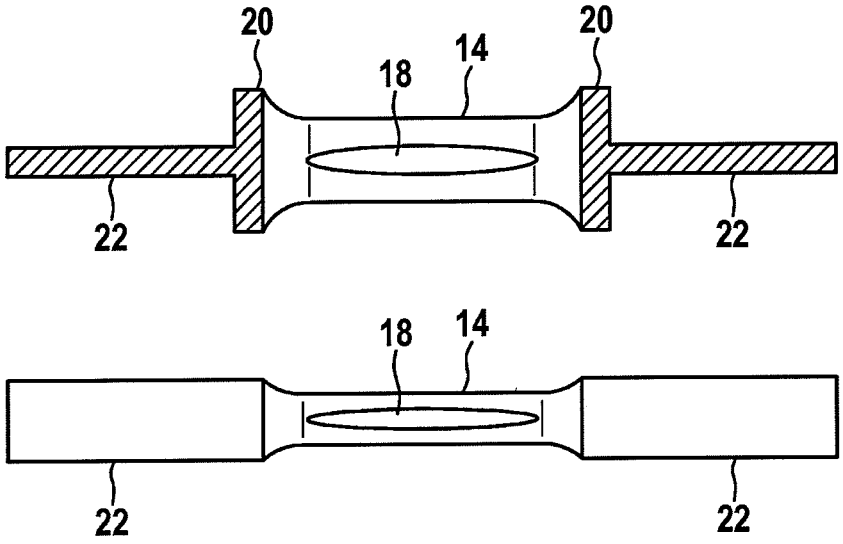
FIG. 7 is an exemplary configuration of a fuse with a flux or activator core in a cross-sectional view and a frontal view.

FIG. 7 depicts an exemplary configuration of such a fuse with a flux or activator core in a cross-sectional view (upper depiction) and a view (lower depiction), wherein it is apparent from the depiction that the activator, respectively flux medium 18, is enclosed.

Figure 8:
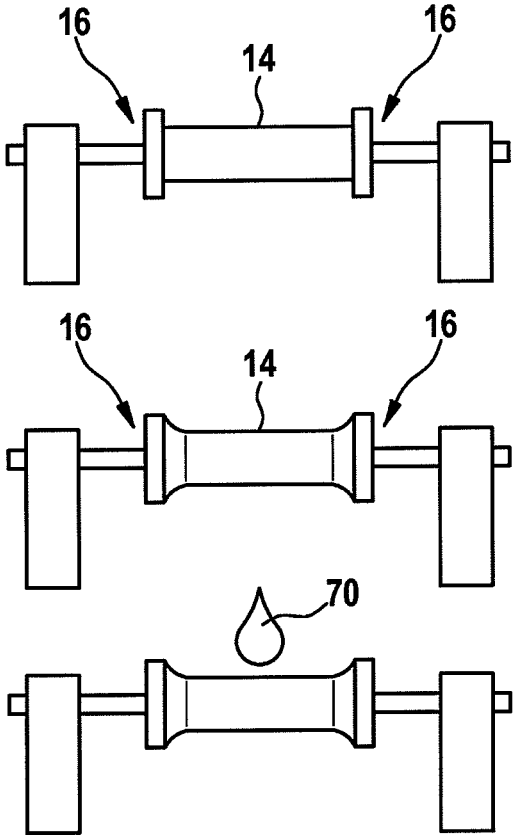
FIG. 8 shows illustrations, which show a procedural approach when applying a flux, respectively activator lacquer, according to an additional example of embodiment of the invention.
Figure 9:
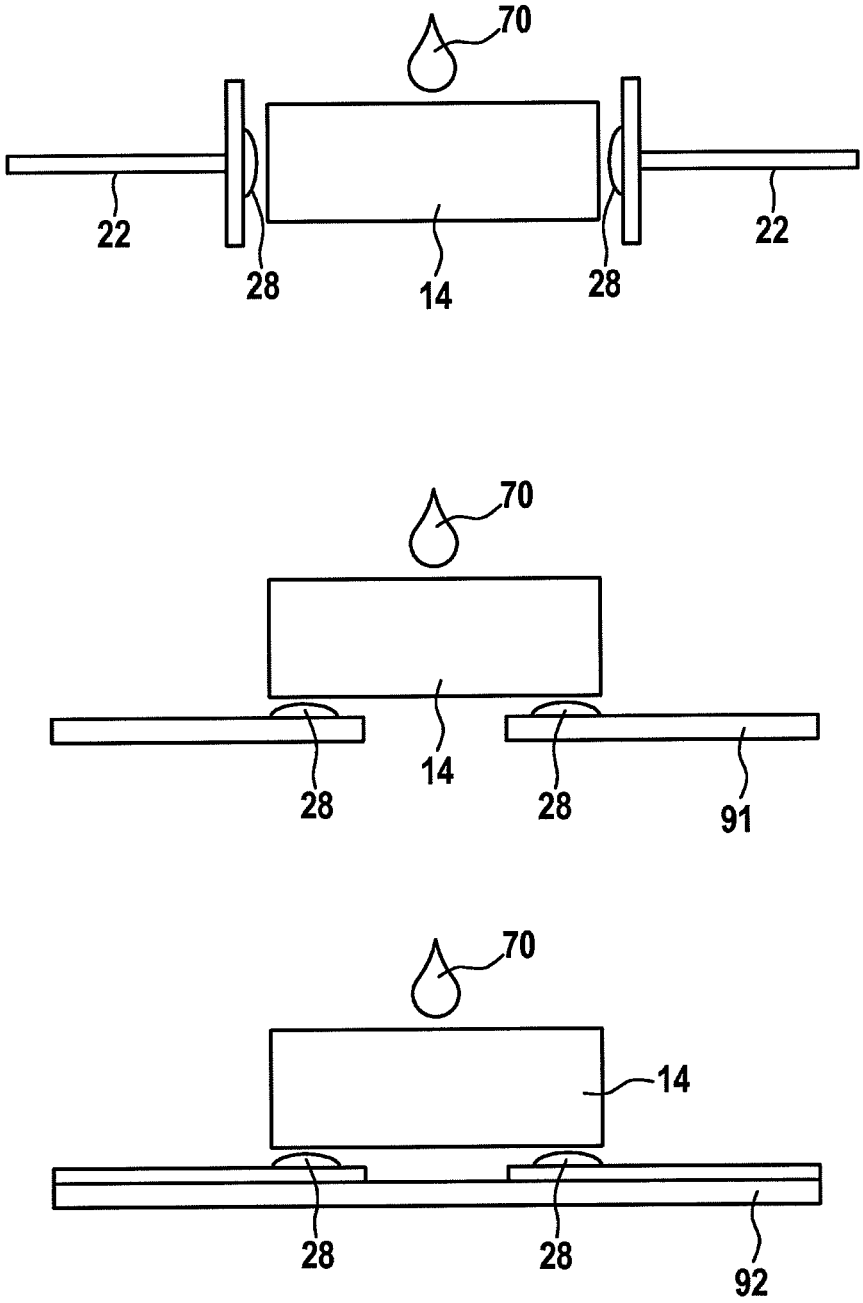
FIG. 9 shows illustrations, which show the application possibilities of the example of embodiment of the invention depicted in FIG. 8.

As an alternative to the fuse with the previously described internal flux core, the molten bridge could also be externally coated with a refractory flux lacquer, respectively activator lacquer. For this purpose, the active substance, for example a carboxylic acid, is mixed with a bonding agent to form a lacquer, which is to be externally applied. FIG. 8 showed the procedural approach for producing such a thermal fuse with a flux lacquer or activator lacquer externally applied. In a first Step 1, the conductor bar 14 is pressed onto to the retaining element 16 and heated up (for example using the reflow technique). In a second Step 2 the heated conductor bar 14 is cooled down, whereby the solder joint with the solder meniscus forms between the conductor bar 14 and the retaining elements 16. In a third Step 3 the so-called "flux-lacquer" 70 is applied to the solder joint produced in the second step in order to coat the molten bridge with the refractory flux lacquer, respectively activator lacquer. In order to adjust the melting point of the applied lacquer, the composition for the application described can even be optimized, for example by means of a variation of the ratio of the carboxylic acid to the bonding agent. Other suitable materials as, for example, salts of the carboxylic acid can be used instead of the carboxylic acid. With respect to the existing fuses, the protective ceramic sleeve can be omitted in this form of embodiment, in particular if the characteristics of the flux lacquer, respectively activator lacquer, meet the following requirements:

- durability at the maximum operating temperature in air (if need be when exposed to salt contamination)
- not, respectively poorly, water soluble
- melting point>$T_{max}$
- negligible vapor pressure at $T_{max}$ (whereby no losses occur through evaporation)
- bonding sufficient for changes in temperature and vibratory strain Vis-à-vis an internal flux core, the necessity for a transient soldering process as is depicted in FIG. 8 would be eliminated. For the same reason, the possible range of application of a thermal fuse with an externally applied flux would also be significantly larger than that of a fuse with a flux core. Whereas the latter may not be heated above its melting temperature neither in the manufacturing nor in the assembly process, this necessity is not a factor in the case of a subsequent application of the flux. Because of this the fuse could also be assembled with a standard soldering process on a PCB or a stamped grid. FIG. 9 exemplary shows different possibilities for applying the flux lacquer, respectively the activator lacquer. In the upper depiction from FIG. 9, the previously described manner of soldering the solder preform to the retaining elements with the aid of solder paste is depicted. In the lower two illustrations comprising FIG. 9, the construction of the thermal fuse with an externally applied flux lacquer or activator lacquer on a stamped grid 91, respectively a PCB 92 (PCB=printed circuit board), is depicted.

The invention claimed is:

1. A fuse for interrupting an electrical conductor in event of a thermal fault, comprising:

a conductor bar providing an electrically conductive connection of the electrical conductor during correct operation, wherein the conductor bar melts upon an increase in temperature above a melting point and the electrically conductive connection of the electrical conductor is interrupted due to inherent surface tension; and a retaining element coupled to at least one end of the conductor bar, wherein the retaining element comprises a first part configured as a hollow body having one open side for holding the conductor bar and a second part for connecting the retaining element to the electrical conductor, wherein the conductor bar is coupled to an interior of the hollow body by a solder joint, wherein a melting point of the solder joint is less than the melting point of the conductor bar and greater than a maximally admissible temperature for correct operation, wherein the maximally admissible temperature is in a range up to 170° Celsius, wherein the conductor bar is further directly coupled to the hollow body in a force-fitting manner by a mechanical deformation of the hollow body, and wherein the hollow body further includes at least one raised portion on an outer circumference that constitutes a point of force application for the mechanical deformation of the hollow body after inserting the conductor bar into the hollow body for holding the conductor bar in the hollow body in a force-fitting manner to directly secure the conductor bar to the hollow body.

2. The fuse of claim 1, wherein the electrical conductor is coupled to a stamped grid, a printed circuit board or the like.

3. The fuse of claim 1, wherein the hollow body further comprises at least one of an additional chamfer and a slot.

4. The fuse of claim 1, wherein the first part and the second part of the retaining element are configured as one piece.

5. The fuse of claim 1, wherein the first part and the second part of the retaining element are one of welded and riveted together.

6. The fuse of claim 1, wherein the second part of the retaining element is configured as one of a bar-like, a wire-like, and a strip-like form.

7. The fuse of claim 1, wherein the second part of the retaining element is angled with respect to a preferred orientation of the conductor bar.

8. The fuse of claim 1, wherein the retaining element is an integral component part of a stamped grid.

9. The fuse of claim 1, wherein the conductor bar comprises of one of a metal, a highly electrically conductive alloy, and a soft solder alloy.

10. The fuse of claim 1, wherein the conductor bar comprises a core that contains an activator medium.

11. The fuse of claim 10, wherein the activator medium is a carboxylic acid.

12. The fuse of claim 10, wherein the core contains a mixture of a carboxylic acid and a resin.

13. The fuse of claim 1, wherein the conductor bar comprises a core that contains a salt of a carboxylic acid.

14. The fuse of claim 1, wherein the conductor bar comprises a flux encasement that contains one of a carboxylic acid and a salt of a carboxylic acid.

15. The fuse of claim 14, wherein the flux encasement comprises a lacquer coating.

16. A method for producing a fuse comprising a retaining element and a conductor bar for interrupting an electrical conductor in event of a thermal fault, the method comprising:

forming the retaining element to include a first and a second part, wherein the second part is formed to connect the retaining element to the electrical conductor, and wherein the first part includes a hollow body with one open side for receiving the conductor bar and at least one raised portion on an outer circumference to be used as a point of force application for mechanical deformation of the hollow body to directly secure the conductor bar to the hollow body in a force fitting manner;

applying a solder to the first part such that at least one of a base and an interior wall of the first part is covered by the solder;

inserting the conductor bar into the open side of the hollow body of the retaining element;

applying a thermal pulse to at least one component selected from a group consisting of the second part of the retaining element, the raised portion of the first part of the retaining element, and the conductor bar, wherein the applied thermal pulse heats the at least one component to a temperature between a melting point of the solder and a melting point of the conductor bar and forms a solder joint between the conductor bar and the retaining element by melting the solder, wherein the melting point of the solder lies beneath that of the conductor bar and above a maximally admissible temperature for correct operation of the fuse, wherein the maximally admissible temperature is in a range up to 170° Celsius; and applying a force to the at least one raised portion on the outer circumference of the hollow body to cause the mechanical deformation of the hollow body and to directly secure the conductor bar to the hollow body in a force fitting manner.

17. The method of claim 16, wherein the thermal pulse is impressed by one of a laser and an infrared light in a non-contact manner.

18. The method of claim 16, wherein the act of inserting the conductor bar into the hollow body is performed before the act of applying the thermal pulse.

19. The method of claim 16, further comprising applying an activator onto the conductor bar.

20. The method of claim 19, wherein the act of applying the activator forms a lacquer layer on the conductor bar.

21. The method of claim 16, further comprising checking a connection of the first part and the conductor bar.

22. The method of claim 21, further comprising optically checking the connection.

23. The method of claim 21, further comprising automatically checking the connection.

24. The method of claim 21, further comprising checking the connection with a probe disposed as to be freely displaceable in order to cover a region to be checked in the first part of the retaining element.

25. The method of claim 21, further comprising supplying an operating result for confirming a flawless soldering if a soldering meniscus is detected upon the conductor bar being one of affixed on and inserted into the first part in one of the force-fitting and the positive-locking manner.

26. A fuse for interrupting a voltage-and-current-carrying conductor in the case of a thermal fault, comprising:

a conductor bar which ensures an electrically conductive connection of the voltage-and current-carrying conductor during correct operation, wherein an increase in temperature above a melting point of the conductor bar causes the conductor bar to melt and interrupts the electrically conductive connection of the voltage-and-current-carrying conductor as a result of its inherent surface tension, and wherein at least one end of the conductor bar is held by a holding element, which has a first part for holding the conductor bar and a second part for connecting the holding element to the voltage-and-current carrying conductor of a leadframe or a printed circuit board, characterized in that the first part is formed as a hollow body that is open on one side to receive the conductor bar and includes at least one raised portion on an outer circumference of the hollow body used as a point of force application for mechanical deformation of the hollow body to directly secure the conductor bar in a force-fitting manner to the hollow body, and wherein the conductor bar is further secured to an interior of the hollow body by a solder, wherein the melting point of the solder lies below that of the conductor bar and above a maximum temperature for correct operation of the fuse.

* * * * *